US012145025B2

(12) United States Patent
Al-Oboudi

(10) Patent No.: US 12,145,025 B2
(45) Date of Patent: Nov. 19, 2024

(54) EXTREMITY FLEXION AND EXTENSION EXERCISER DEVICES

(71) Applicant: Waleed Al-Oboudi, San Diego, CA (US)

(72) Inventor: Waleed Al-Oboudi, San Diego, CA (US)

( * ) Notice: Subject to any disclaimer, the term of this patent is extended or adjusted under 35 U.S.C. 154(b) by 59 days.

(21) Appl. No.: 17/660,891

(22) Filed: Apr. 27, 2022

(65) Prior Publication Data

US 2022/0347520 A1 Nov. 3, 2022

Related U.S. Application Data

(60) Provisional application No. 63/201,442, filed on Apr. 29, 2021.

(51) Int. Cl.
*A63B 23/035* (2006.01)
*A63B 21/00* (2006.01)

(52) U.S. Cl.
CPC .... *A63B 23/03508* (2013.01); *A63B 21/4035* (2015.10)

(58) Field of Classification Search
CPC ..... A63B 23/03508; A63B 21/4035; A63B 21/00181; A63B 2023/006; A63B 2225/09
See application file for complete search history.

(56) References Cited

U.S. PATENT DOCUMENTS

| | | | | |
|---|---|---|---|---|
| 8,435,162 | B1 * | 5/2013 | Al-Oboudi | A63B 21/0615 482/92 |
| 10,058,756 | B1 * | 8/2018 | Basilone | A63B 69/0002 |
| 2014/0128229 | A1 * | 5/2014 | York | A63B 21/078 482/104 |
| 2018/0098905 | A1 * | 4/2018 | Nelson | A63B 23/0494 |
| 2018/0229076 | A1 * | 8/2018 | Nalley | A63B 21/154 |
| 2019/0282851 | A1 * | 9/2019 | Hockridge | A63B 23/1218 |

* cited by examiner

*Primary Examiner* — Loan B Jimenez
*Assistant Examiner* — Andrew M Kobylarz
(74) *Attorney, Agent, or Firm* — Knobbe Martens Olson & Bear LLP

(57) ABSTRACT

An extremity flexion and extension exerciser device is described. The device includes a joint supported by a base, a rotating arm mounted on the joint, the rotating arm including a first side extending from the joint in a first direction, and a second side extending from the joint in a second direction opposite the first direction, a handle or paddle attached to a distal end of the first side of the rotating arm, and one or more weights are selectively attachable to the second side of the rotating arm.

10 Claims, 5 Drawing Sheets

EXTREMITY FLEXION AND EXTENSION EXERCISER DEVICES

PRIORITY APPLICATION(S)

This application claims priority to U.S. Provisional Application No. 63/201,442, filed Apr. 29, 2021, which is incorporated herein by reference. Any and all applications for which a foreign or domestic priority claim is identified in the Application Data Sheet as filed with the present application are hereby incorporated by reference under 37 CFR 1.57.

BACKGROUND

Field

This application relates generally to orthotic, therapeutic, and stretching devices, and in particular, to flexion and extension exerciser devices configured to help a user move his or her arms and/or legs in flexion and extension, for example, as part of a rehabilitation or strengthening program.

Description

Shoulder and hip mobility are important for posture and movement. Modern living, which frequently involves sitting for long periods of times, can lead to tight or weak shoulders and/or hips, leading to discomfort, pain, or a lack of mobility. Accordingly, there is a need for a device that can be used as a therapy aid to help users recover or improve shoulder and hip mobility.

SUMMARY

The extremity flexion and extension exerciser systems, methods and devices described herein have innovative aspects, no single one of which is indispensable or solely responsible for their desirable attributes. Without limiting the scope of the claims, some of the advantageous features will now be summarized.

In a first aspect, an extremity flexion and extension exerciser device is described that includes: a joint supported by a base; a rotating arm mounted on the joint, the rotating arm including a first side extending from the joint in a first direction, and a second side extending from the joint in a second direction opposite the first direction; a handle or paddle is attached to a distal end of the first side of the rotating arm; and one or more weights are selectively attachable to the second side of the rotating arm.

The device may also include one or more of the following features in any combination: an adjustable beam extending between the base and the joint, the adjustable beam comprising an adjustable length; wherein the adjustable beam comprises a telescoping beam; wherein the adjustable beam is configured such that the adjustable length can be set at a height of a user's shoulder or a height of a user's hip; wherein the handle or paddle are removably attachable to the first side of the rotating arm and can be removed and replaced with the other of the handle or paddle; wherein the rotating arm is configured in shape to avoid contacting a user during use; wherein the first side of the rotating arm is angled toward the user during use and the second side of the rotating arm is angled away from the user during use.

In another aspect, a method for improving extremity flexion and extension is described that includes providing the device described above; adjusting the height of the joint to align with a user's shoulder; gripping the handle; and rotating an arm of the user through flexion and extension by rotating the rotating arm about the joint.

In another aspect, a method for improving extremity flexion and extension is described that includes providing the device described above; adjusting the height of the joint to align with a user's hip; positioning a user's foot against the paddle; and rotating a leg of the user through flexion and extension by rotating the rotating arm about the joint.

BRIEF DESCRIPTION OF THE DRAWINGS

The above-mentioned aspects of the extremity flexion and extension exerciser systems, methods, and devices described herein, as well as other features, aspects, and advantages of the present technology will now be described in connection with various embodiments, with reference to the accompanying drawings. The illustrated embodiments, however, are merely examples and are not intended to be limiting. Like reference numbers and designations in the various drawings indicate like elements.

DETAILED DESCRIPTION

This application is directed to extremity flexion and extension exerciser devices. As will be described in more detail below, the extremity flexion and extension exerciser devices can be used to aid a user in rehabilitating, improving, or otherwise strengthening the user's ability to move his or her extremities—arms and legs—in extension and flexion.

In the following detailed description, reference is made to the accompanying drawings, which form a part of the present disclosure. These illustrative embodiments are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and form part of this disclosure.

Figure 1:
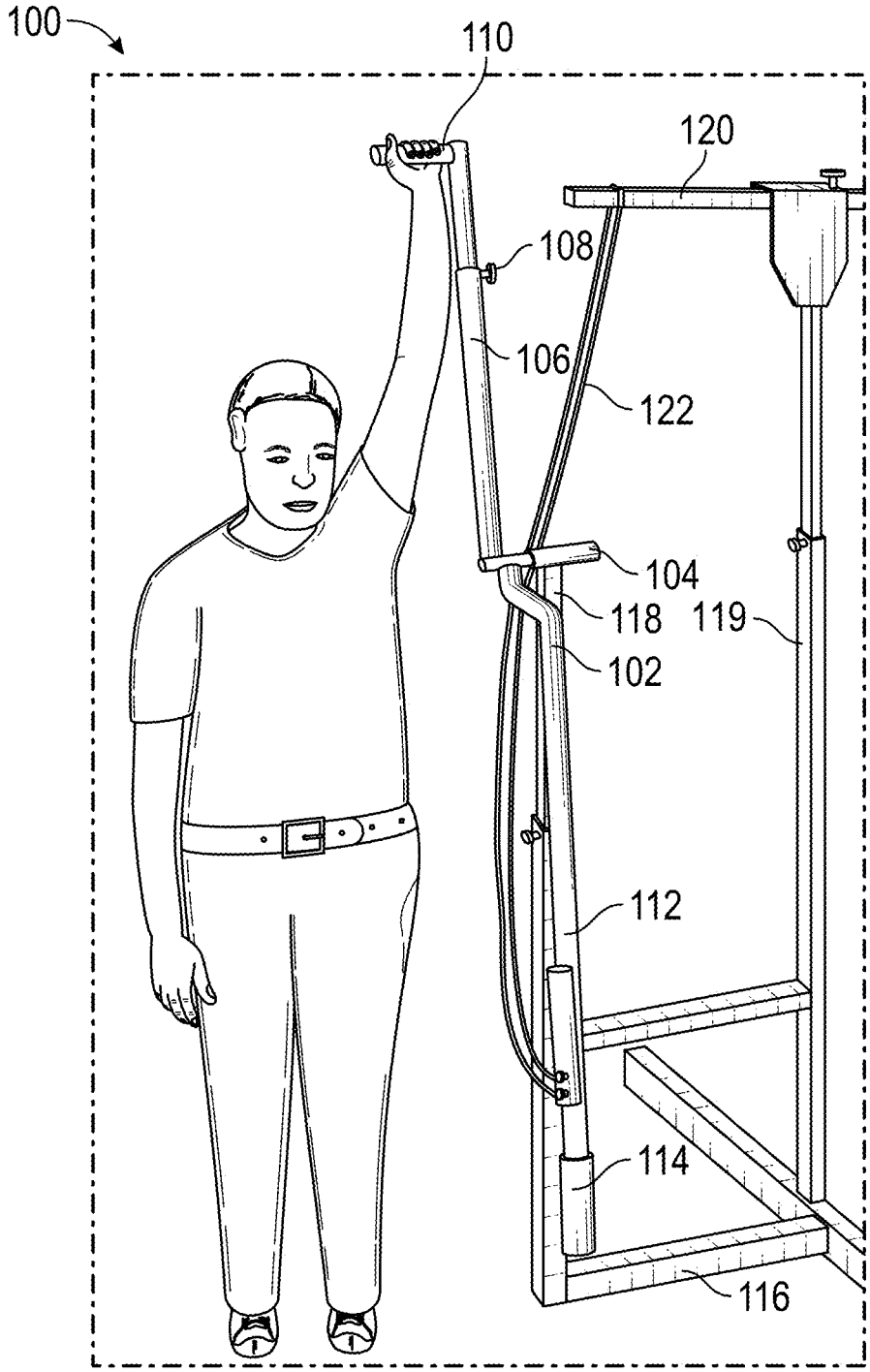
FIG. 1 illustrates an embodiment of an extremity flexion and extension exerciser device during use in a first position.
Figure 2:
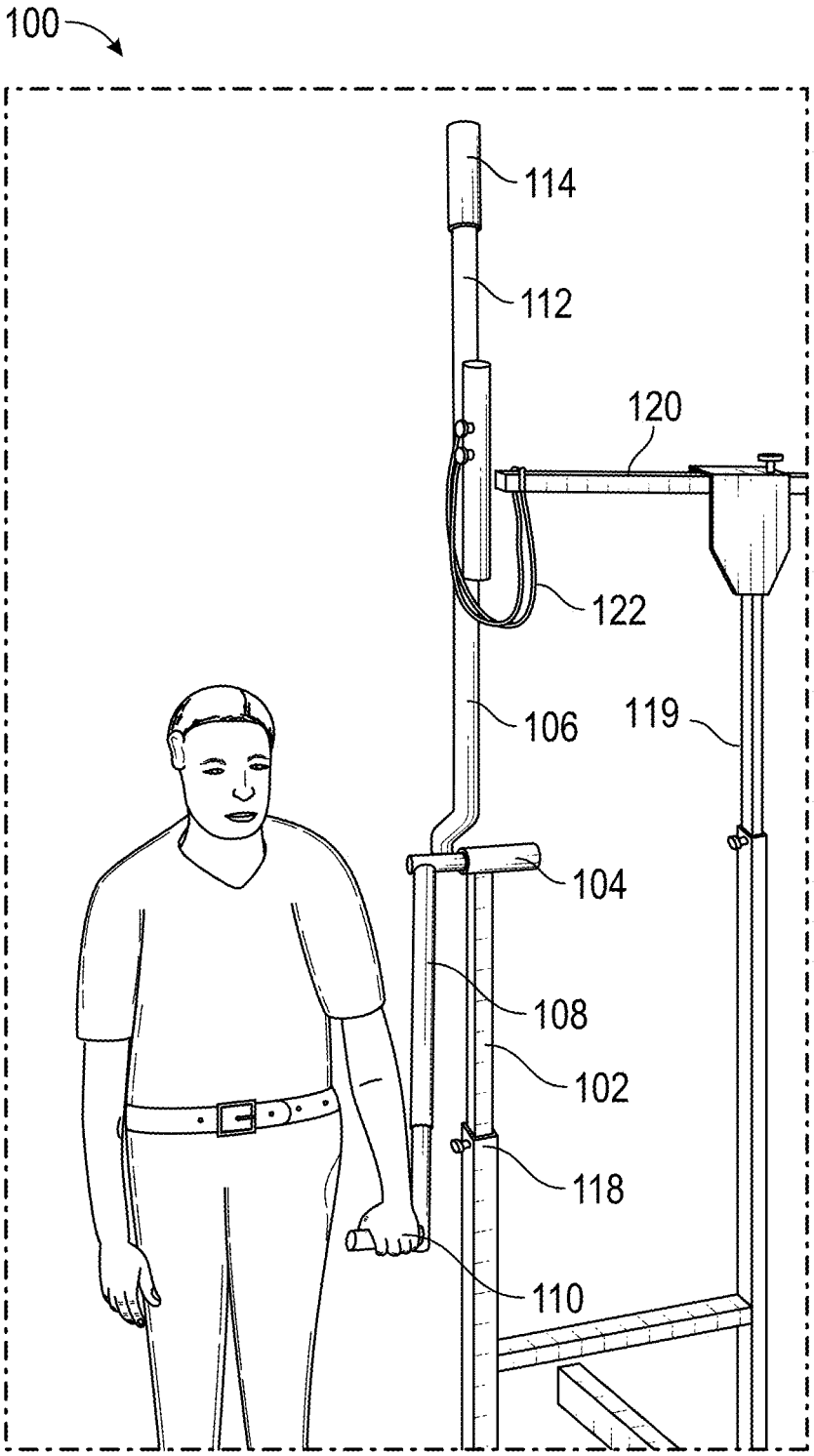
FIG. 2 illustrates the extremity flexion and extension exerciser device of FIG. 1 during use in a second position.
Figure 3A:
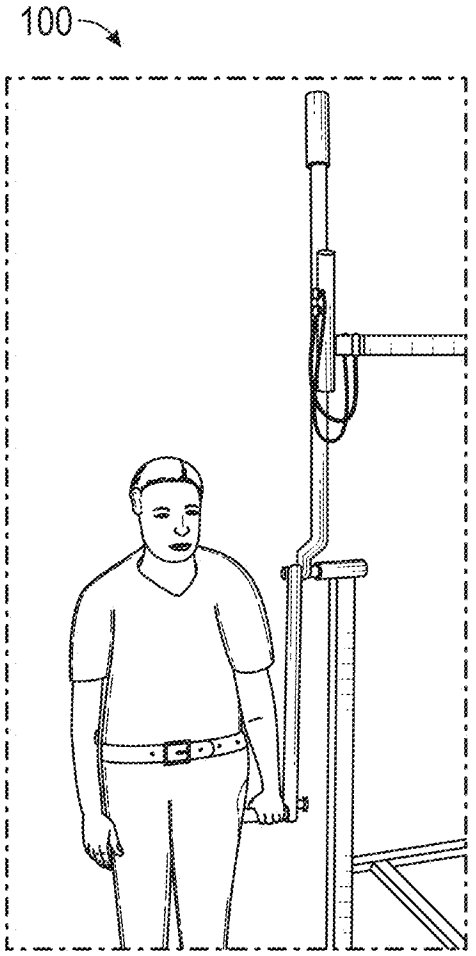
FIGS. 3A-3I provide additional views of the extremity flexion and extension exerciser device of FIG. 1 during use, showing various stages of a user moving his arm from flexion to extension and back to flexion.
Figure 3B:
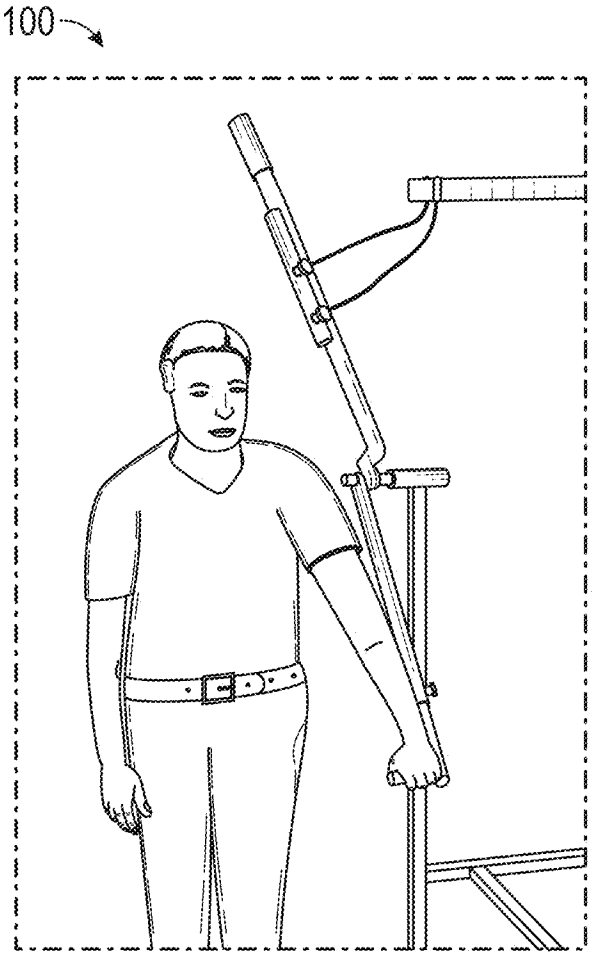
Figure 3C:
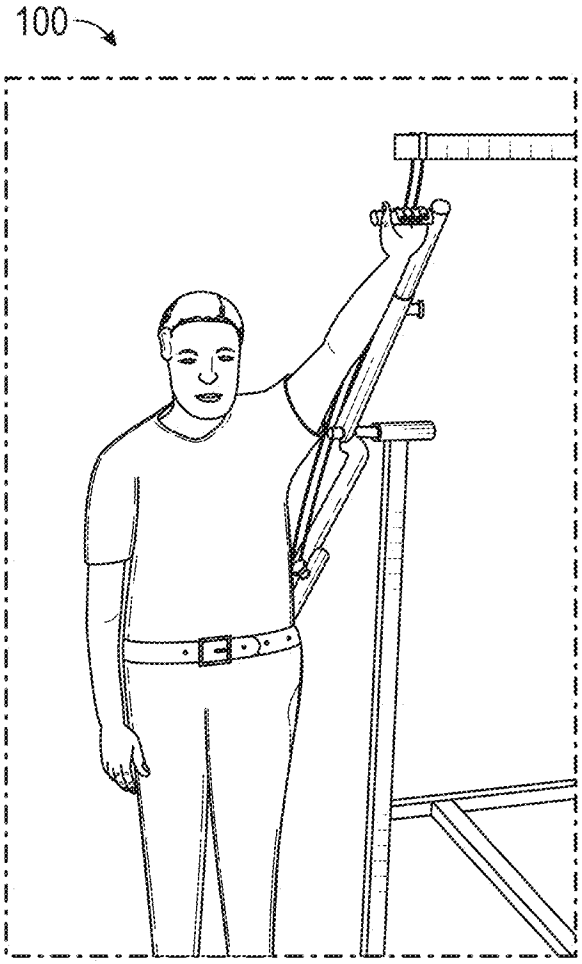
Figure 3F:
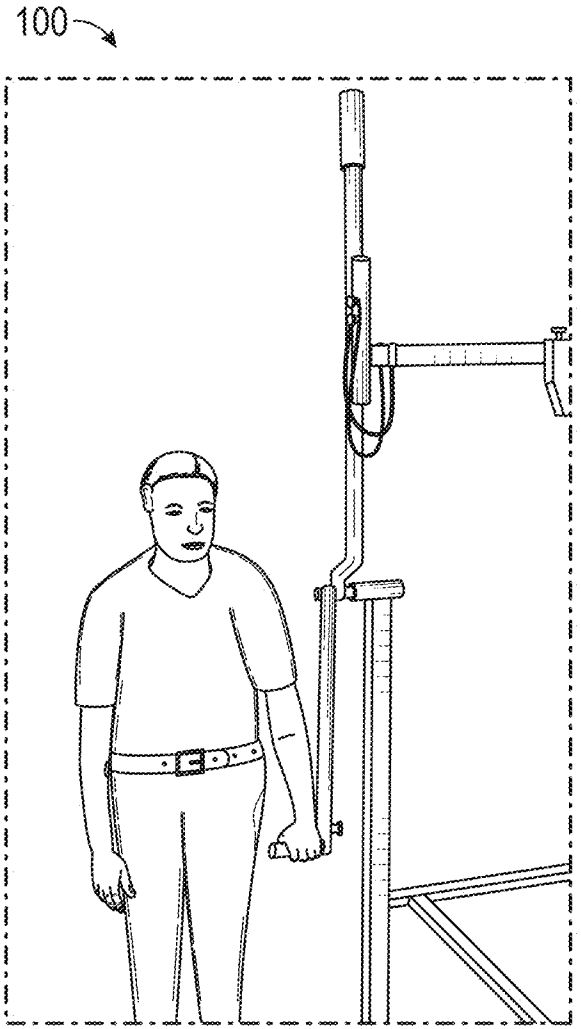
Figure 3E:
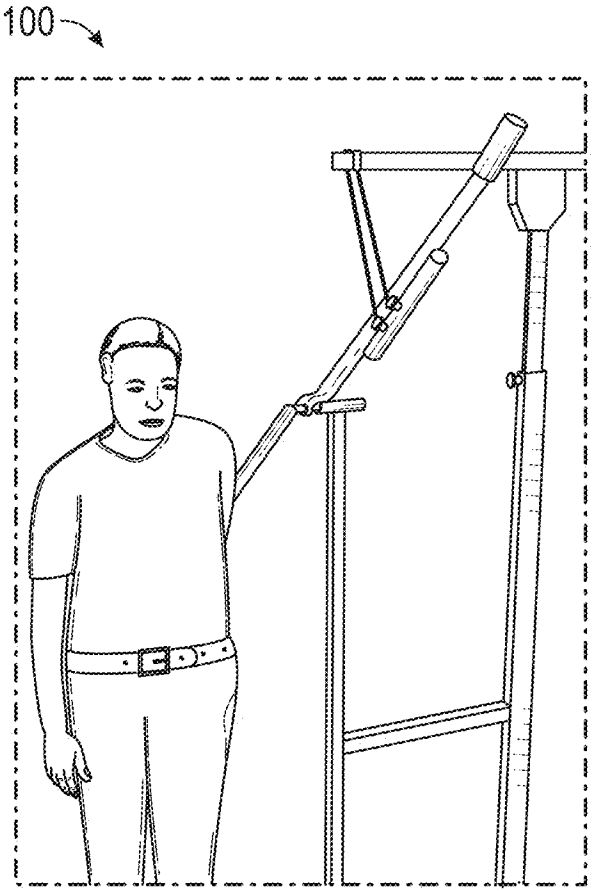
Figure 3D:
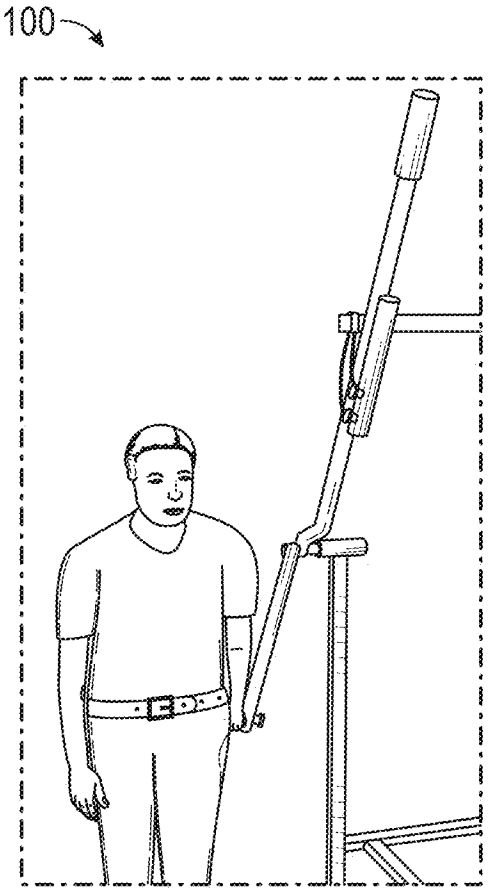
Figure 3I:
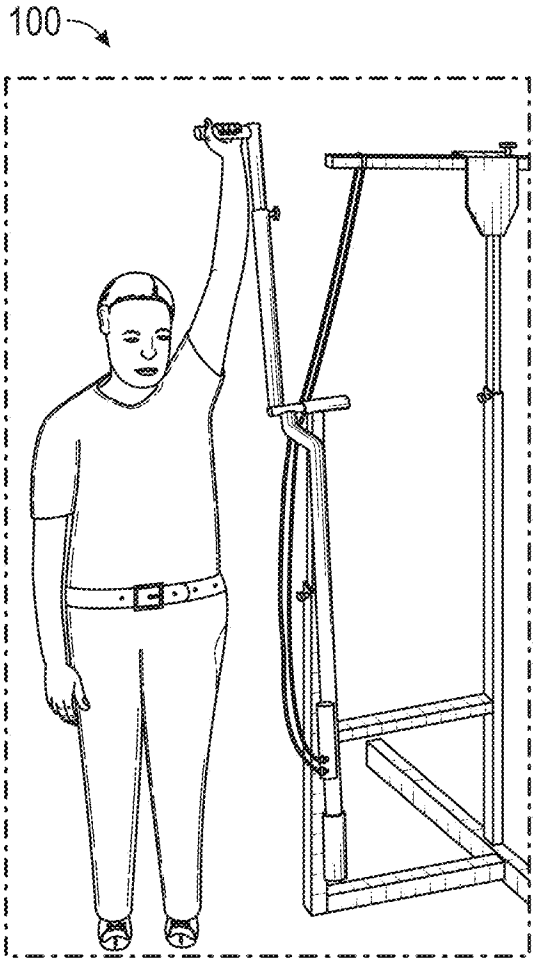
Figure 3H:
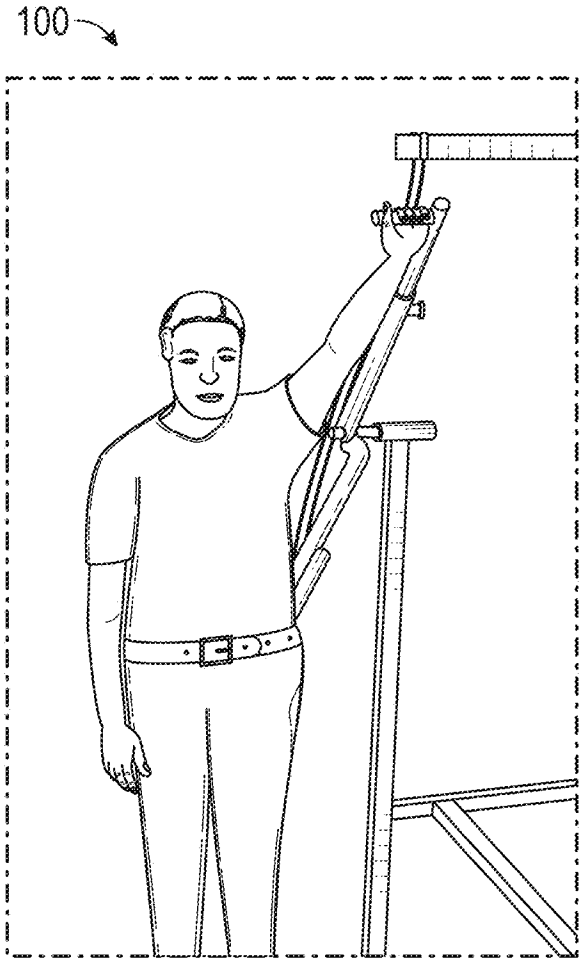
Figure 3G:
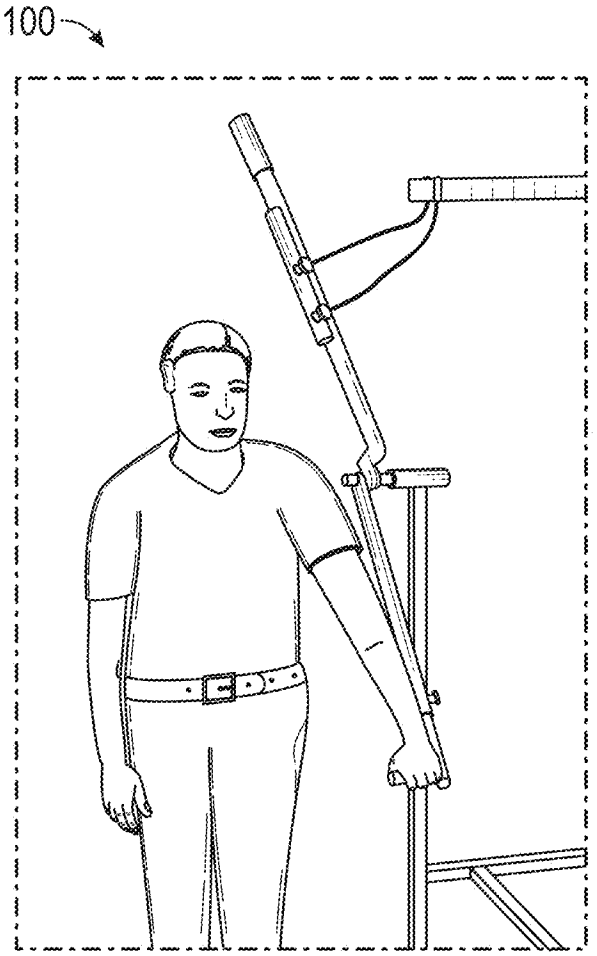

FIGS. 1 and 2 illustrate an embodiment of an extremity flexion and extension exerciser device 100. In FIGS. 1 and 2, the extremity flexion and extension exerciser device 100 is illustrated during use. As will be described in more detail below, the extremity flexion and extension device 100 is configured to aid a user in moving one of his or her extremities (e.g., an arm or a leg) through a range of motion that provides extension and or flexion. The extremity flexion and extension device 100 can be configured to rehabilitate, strengthen, and/or stretch a joint associated with the extremity, such as a shoulder or hip joint. The extremity flexion and extension device 100 can be used as part of a rehabilitation, recovery, or strengthening program to rehabilitate and/or strengthen the shoulder and/or hip joint. Use of the device can improve the user's shoulder or hip mobility, which can reduce pain, increase the use of the extremity, and or provide other benefits to the user.

FIGS. 1 and 2 illustrate the device when used on the user's arm. FIG. 1 shows the arm in an extension position (as aided by the extremity flexion and extension device 100), and FIG. 2 shows the arm in a flexion position (as aided by the extremity flexion and extension device 100). Although the figures illustrate the extremity flexion and extension device 100 during use on an arm, the extremity flexion and extension device 100 can also be configured for use on a user's leg, as will be described in more detail below. For readability, the extremity flexion and extension device 100 will be referred to hereafter simply as the device 100.

As shown in FIGS. 1 and 2, the device 100 can include a base 102, a joint 104, and a rotating arm 106. The rotating arm 106 can include a first side 108 and a second side 112. A handle 110 can be positioned on a distal end of the first side 108. In some embodiments, the handle can be replaced with a paddle as described in more detail below. Weights 114 can be positioned on a distal end of the second side 112. In some embodiments, the weights 114 can be removable and/or adjustable such that the amount of weight that can be added to the second side 112 of the rotating arm 106 can be adjusted.

The base 102 is configured to support the device 100. The base can comprise a frame, for example, as illustrated in the figures, that provides the structural strength, rigidity, and stability for the device 100. In some embodiments, the base 102 comprises feet 116. The feet 116 can be configured to rest on a support surface, such as the ground of the floor. The base 102 is configured to support and position the remaining components of the device 100.

For example, in the illustrated embodiment, an adjustable beam 118 extends upwardly from the base 102. The adjustable beam 118 can be attached on a lower end to the base 102 and on an upper end to the joint 104. That is, the joint 104 can be positioned on an upper end of the adjustable beam 118. The adjustable beam 118 can be configured such that a length thereof can be adjusted. Adjusting the length of the adjustable beam 118 can advantageously adjust the height of the joint 104, which will be described in more detail below. In some embodiments, the adjustable beam 118 comprises a telescoping beam that includes one or more components that are arranged in a telescoping fashion such that the overall length of the adjustable beam 118 can be varied. Other mechanisms and structures for adjusting the length of the adjustable beam 118 are possible. Additionally, Other mechanisms and structures for adjusting the height of the joint 104 are possible. For example, the adjustable beam 118 can be replaced with a static or non-adjustable beam, and the joint 104 can be configured to move along the length of the beam such that the height of the joint 104 can be adjusted. In some embodiments, the adjustable beam 118 can be replaced with a static or non-adjustable beam and the height of the joint 104 is not adjustable.

In preferred embodiments, the height of the joint 104 is adjustable. This can, for example, permit use of the device 100 by users of different sizes or heights, as well as permit the device 100 to be used by different extremities, such as the arm and the leg. During use, the joint 104 is ideally positioned so as to be level with the joint of the extremity that is used with the device 100. For example, when the device 100 is used by an arm, the joint 104 is ideally positioned at a height that aligns with the user's shoulder. Similarly, when the device 100 is used by a leg, the joint 104 is ideally positioned at a height that aligns with the user's hip. Accordingly, during use, the height of the joint 104 is set according to the user and extremity, for example, using the adjustable beam 118 or other mechanisms. Once set, the position or height of the joint 104 generally remains constant or stationary during use. Accordingly, a locking mechanism may be included that locks the position or height of the joint 104 after it is set.

The joint 104 connects the rotating arm 106 to the adjustable beam 118. The joint 104 allows the rotating arm 104 to rotate relative to the remainder of the device 100 (such as the adjustable beam 118 and/or base 102). In some embodiments, the joint 104 is configured to rotated about an axis of the joint 104.

As shown in FIGS. 1 and 2, rotating arm 106 is mounted to the joint 104. A first side 108 of the rotating arm 106 extends from the joint 104 to a first distal end, and a second side 108 of the rotating arm extends from the joint 104 to a second distal end. In the illustrated embodiment, a handle 110 is positioned on the first distal end of the first side 108. During use, the user can grip the handle 110 as shown. In some embodiments, the handle 110 is replaced with a paddle. In embodiments, the use a paddle, the user can press against the paddle with his or her hand to move the rotating arm 106, or the user can press against the paddle with his or her foot to move the rotating arm 106 with his or her leg. Other mechanisms for attaching, gripping, pressing against, etc., the rotating arm 106 with a hand or foot, for leg or arm use, respectively, are also possible. In some embodiments, the first end 108 of the rotating arm is configured such that different end pieces (e.g., handles, or paddles) can be selectively used as desired. For example, the user may remove a handle and replace it with a paddle.

The second side 112 of the rotating arm 106 can include weights 114 positioned thereon. The weights 114 can be integrated into the rotating arm 106, or the weights 114 can be configured to selectively attach to the rotating arm 106. Use of weights 114 that can selectively attach to the rotating arm 106 can allow the amount of weight to be adjusted. In the illustrated embodiments, the weights 114 are positioned on a distal end of the second side 112 of the rotating arm 106. Other positions, for example, positions between the pivot 104 and the distal end of the second side 112 of the rotating arm 106, for the weights 114 are also possible.

The rotating arm 106 can be configured such that the rotating arm 106 avoids contacting the user's body during use. For example, and as shown in the illustrated configuration, the first end 108 of the rotating arm 106 can be angled slightly towards the user, while the second end 112 of the rotating arm 106 can be angled slightly away from the user. This can prevent or reduce the likelihood that the weights 114, for example, hit the user's legs or head during rotation of the rotating arm 106. Other embodiments or shapes for the rotating arm 106 are also possible, such as a straight bar or bar that includes one or more curves or steps.

As best shown in FIGS. 3A-3I, which illustrate examples stages in use of the device on a user's arm, the user can position the pivot 104 at shoulder height and then grip the handle 110 with the hand of the arm to be exercised. The user then moves his or her arm through flexion and extension by pivoting the rotating arm 106 about the pivot 104. Advantageously, the weights 114 positioned on the rotating arm 106 opposite the handle 110 can counterbalance the weight of the user's arm, allowing for a smooth and/or assisted motion. This can allow the device to be used by user's who may be too weak to comfortably move their arms through flexion and extension. Use of the device on a leg can be similar. The pivot 104 can be positioned at hip height, and then the user can move his or her leg through flexion and extension by rotating the rotating arm 106 with the user's leg. Again, the motion can be assisted by the weights 114 on the rotating arm 106.

Returning to FIGS. 1 and 2, in some embodiments, one or more bands 122 can also be included to further assist in the motion. In the illustrated embodiment, bands 122 extend between a band support beam 120 of a frame structure of the base 102 and the second side 112 of the rotating arm 106. The band support beam 120 can be supported by a second beam 119 that extends from the base 116. The bands 122 can help ensure controlled rotation and/or provide additional assistance to the user. The bands 122 need not be included in all embodiments.

In the illustrated embodiments, the device 100 is shown during use by a standing user. In other examples, the device 100 may be used by a seated user. For example, the height of the pivot can be adjusted to the height of the user's shoulder while seated.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate that direction terms, such as "upper" and "lower," are sometimes used for ease of describing the figures, and indicate relative positions corresponding to the orientation of the figure on a properly oriented page, and may not reflect the proper orientation of the device as implemented.

Certain features that are described in this specification in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

In describing the present technology, the following terminology may have been used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes, and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

Elements that are described as "connected," "engaged," "attached," or similarly described, shall include being directly and/or indirectly connected, engaged, attached, etc.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. Conjunctions, such as "and," "or" are used interchangeably and are intended to encompass any one element, combination, or entirety of elements to which the conjunction refers.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

What is claimed is:

1. An extremity flexion and extension exerciser device, comprising:

a base configured to rest on a ground surface;

a first beam extending upwardly from the base;

a joint positioned on a distal end of the first beam;

a rotating arm mounted on the joint, the rotating arm including a first side extending from the joint in a first direction, and a second side extending from the joint in a second direction opposite the first direction;

a handle attached to an end of the first side of the rotating arm;

one or more weights selectively attached to an end of the second side of the rotating arm;

a second beam extending upwardly from the base, the second beam parallel to the first beam;

a band support beam extending from a distal end of the second beam; and one or more elastic bands extending between the band support beam and the second side of the rotating arm.

2. The device of claim 1, wherein the first beam comprises a first adjustable beam extending between the base and the joint, the first adjustable beam comprising an adjustable length.

3. The device of claim 2, wherein the first adjustable beam comprises a telescoping beam.

4. The device of claim 2, wherein the first adjustable beam is configured such that the adjustable length can be set such that the joint is positioned at a height of a user's shoulder or a height of a user's hip.

5. The device of claim 1, wherein the second beam is longer than the first beam such that the band support beam is positioned above the joint.

6. The device of claim 5, wherein the second beam comprises an adjustable length such that a height of the band support beam is adjustable.

7. The device of claim 1, wherein the rotating arm is configured in shape to avoid contacting a user during use.

8. The device of claim 1, wherein the first side of the rotating arm is angled toward the user during use and the second side of the rotating arm is angled away from the user during use.

9. A method for improving extremity flexion and extension, the method comprising:

providing an extremity flexion and extension exerciser device, comprising:

a base configured to rest on a ground surface; a first beam extending upwardly from the base;

a joint positioned on a distal end of the first beam;

a rotating arm mounted on the joint, the rotating arm including a first side extending from the joint in a first direction, and a second side extending from the joint in a second direction opposite the first direction;

a handle attached to an end of the first side of the rotating arm; one or more weights selectively attached to an end of the second side of the rotating arm; a second beam extending upwardly from the base, the second beam parallel to the first beam;

a band support beam extending from a distal end of the second beam; and one or more elastic bands extending between the band support beam and the second side of the rotating arm;

wherein the first beam comprises a first adjustable beam extending between the base and the joint, the first adjustable beam comprising an adjustable length;

adjusting the height of the joint to align with a user's shoulder;

gripping the handle; and rotating an arm of the user through flexion and extension by rotating the rotating arm about the joint.

10. A method for improving extremity flexion and extension, the method comprising:

providing an extremity flexion and extension exerciser device, comprising:

a base configured to rest on a ground surface;

a first beam extending upwardly from the base;

a joint positioned on a distal end of the first beam;

a rotating arm mounted on the joint, the rotating arm including a first side extending from the joint in a first direction, and a second side extending from the joint in a second direction opposite the first direction;

a handle attached to an end of the first side of the rotating arm;

one or more weights selectively attached to an end of the second side of the rotating arm; a second beam extending upwardly from the base, the second beam parallel to the first beam;

a band support beam extending from a distal end of the second beam; and one or more elastic bands extending between the band support beam and the second side of the rotating arm;

wherein the first beam comprises a first adjustable beam extending between the base and the joint, the first adjustable beam comprising an adjustable length;

adjusting the height of the joint to align with a user's hip;

positioning a user's foot against the handle; and rotating a leg of the user through flexion and extension by rotating the rotating arm about the joint.

* * * * *